United States Patent [19]

Scribner

[11] 4,339,194

[45] Jul. 13, 1982

[54] COLD PRESSURE FUSING APPARATUS

[75] Inventor: Albert W. Scribner, Darien, Conn.

[73] Assignee: Pitney Bowes Inc., Stamford, Conn.

[21] Appl. No.: 168,214

[22] Filed: Jul. 10, 1980

[51] Int. Cl.[3] ..... G03G 15/00

[52] U.S. Cl. ..... 355/3 FU; 100/172; 100/176; 219/216; 432/60

[58] Field of Search ..... 355/3 R, 3 FU; 219/216, 219/469; 432/60, 228; 100/164, 172, 176

[56] References Cited

U.S. PATENT DOCUMENTS

| | | | |
|---|---|---|---|
| 3,213,709 | 10/1965 | Bjork | 100/172 X |
| 3,854,975 | 12/1974 | Brenneman et al. | 355/3 FU X |
| 3,988,061 | 10/1976 | Root | 355/3 FU X |

*Primary Examiner*—Fred L. Braun

*Attorney, Agent, or Firm*—Melvin J. Scolnick; William D. Soltow, Jr.; Albert W. Scribner

[57] ABSTRACT

A cold pressure fusing apparatus for use in a xerographic copying machine for fixing a developed toner image to a copy sheet has the combination of elements including a first roller rotatably-mounted in the copying machine; a mechanism for driving the first roller; a second rotatably mounted roller in pressure contact with the first roller whereby a nip is formed through which copy sheets being fused pass; and a braking device operatively connected to the second roller for applying a controlled braking torque to the second roller, the torque being of such magnitude sufficient to facilitate the fusing of toner particles into the copy sheet without producing substantially any smudging of these particles, but of a magnitude insufficient to cause skidding of the second roller relative to the first roller.

1 Claim, 3 Drawing Figures

COLD PRESSURE FUSING APPARATUS

BACKGROUND OF THE DISCLOSURE

I. Field of the Invention

This invention relates to a fusing apparatus as is commonly used in xerographic copying machines, and more particularly to a cold pressure fusing apparatus for fusing toner images on a support surface, such as a sheet of paper, by applying a plurality of pressure fusing roller strokes to a toned copy sheet.

II. Description of the Prior Art

In a typical xerographic process a photoconductor comprising a photoconductive composition coated on a rigid or flexible substrate is uniformly electrostatically charged in the dark and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is removed and the photoconductor is reused as described above for subsequent copies. The toner image that was transferred to the plain paper is then fixed thereto. This can be accomplished by using a developing material that is heat fusible with the application of sufficient heat and pressure to the paper to cause the developing material to melt and be fused into the paper so as to be permanently affixed thereto, or by using a cold pressure fusing technique where, for example, cold pressure fusible toner particles on a paper substrate are passed under pressure through the nip formed between a pair of opposed and cooperating hard surfaced rollers whereby the toner particles are by pressure alone fused into the paper.

Typically, in the so-called heat pressure fusing apparatus, the paper with the toner image thereon is passed between a pair of opposed and cooperating rollers, at least one of which is heated. Generally, the heated roll is formed of a hollow cylinder having a radiant heater, such as an infrared lamp or a halogen lamp, centrally located within the cylinder to heat the roll, in series with a bimetal thermostat. During operation of the fusing apparatus, the paper to which the toner images are electrostatically adhered, is passed through the nip formed between the rolls with the toner image contacting the fuser roll to effect heating of the toner image within the nip. Fusing is enhanced by the second roll or pressure roll as it is commonly called as the result of a biasing force which forces the rolls into engagement. This type of fusing apparatus, while exhibiting effective results in many instances, does have certain disadvantages. For example, heat fusing requires that a rather large supply of heat be available. This typically requires a supply of electric power in large quantity which is expensive. Furthermore, the amount of heat generally used in a heat fusing apparatus present the possibility of overheating the substrate as well as the toner, thereby producing some danger of a fire.

To avoid the disadvantages of the heat and pressure fusing systems, it is preferred in many instances to use a cold pressure fusing system where electrostatic toner powder images on a substrate are fixed to the substrate by the application of pressure alone. However, cold pressure fusing systems also present some difficulties. For example, since the fixing of the toner to the substrate is accomplished by pressure alone, large amounts of pressure must be applied to the rollers which therefore must of necessity be constructed of sufficient strength and size to withstand these pressures. This, of course, tends to make these systems mechanically complex, inefficient, and expensive. Employing large amounts of pressure to a toned copy sheet also tends to interfere with the quality appearance of the fused image. Examples of some prior art systems which have sought to overcome some of the above-described difficulties are described in U.S. Pat. Nos. 3,931,793 and 3,988,061 and British Pat. No. 2,006,111.

The present invention seeks to overcome the basic problems associated with cold pressure fusing, and provide a cold pressure fusing system which is efficient, employs lower fusing pressures, and a system that will tend to improve the appearance of the final copy.

SUMMARY OF THE INVENTION

It is therefore an object of the present invention to provide a cold pressure fusing apparatus which exhibits a high mechanical efficiency in applying pressure to a support surface.

It is a further object of the present invention to provide a cold pressure fusing apparatus which is simple in design and does not require the use of large and heavy rollers.

It is a further object to this invention to provide a cold pressure fusing apparatus that is relatively inexpensive.

It is a further object of the present invention to provide a cold pressure fusing apparatus that will employ lower fusing pressure than that generally required for cold pressure fusing processes.

It is yet a further object of the present invention to provide a cold pressure fusing apparatus that will improve the appearance of the final copy.

The foregoing objects and others are accomplished in accordance with the present invention by providing a cold pressure fusing apparatus for use in a xerographic copying machine for fixing a developed toner image to a copy sheet. The apparatus includes the combination of elements comprising a first roller rotatably mounted in the copying machine; driving means operatively connected to the first roller; a second roller rotatably mounted and in pressure contact with the first roller whereby a nip is formed through which copy sheets being fused pass; and braking means operatively connected to the second roller for applying a controlled braking torque to the second roller, the torque being of such magnitude sufficient to facilitate the fusing of toner particles into the copy sheet without producing substantially any smudging of the toner particles, but of a magnitude insufficient to cause skidding of the second roller relative to the first roller.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
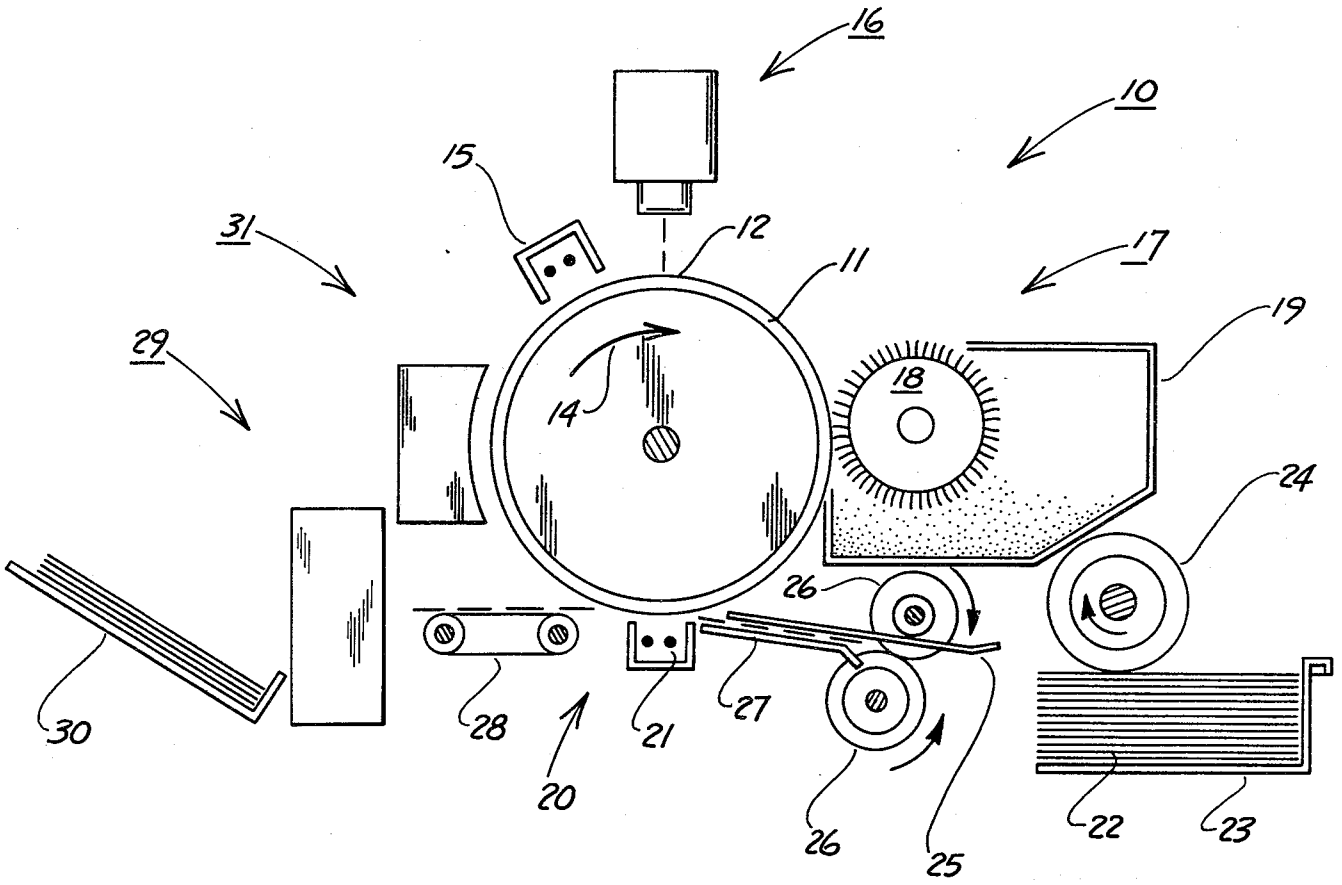
FIG. 1 is a schematic sectional view of a copier.

Referring now to the drawings, and particularly to FIG. 1 thereof, there is shown an electrophotographic copying machine employing a fusing device in which the improved fusing apparatus in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of a xerographic process, and in particular, how a fusing apparatus is employed in such a process. An improved fusing apparatus in accordance with the present invention may be utilized in a wide variety of devices including coated paper copiers and plain paper copiers, and is not necessarily limited to the particular type of copier system shown in FIG. 1.

In FIG. 1, reference numeral 10 generally designates an electrophotographic copying machine which includes a rotating drum 11 having a photoconductive surface 12 secured around the outer surface of the drum. Any of the numerous inorganic or organic photoconductive materials can be employed, such as for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor 12 by the exposure and imaging station generally designated 16. This station could, for example, include a reciprocating carriage that is movably mounted on top of the copying machine cabinet. The carriage would include a transparent platen on which documents are placed face down for copying. Overlying the platen would be a movable cover connected to one side of the carriage. An operator can raise and lower the cover and thereby place on or remove documents from the platen. A series of lamps would be used to illuminate the original document. By incorporating an optical system comprising a series of mirrors and lenses a light image of the original document to be copied is projected onto the charged portion of photoconductive surface 12. The movement of the carriage and therefore the scanning of the original document is in timed relationship with the movement of rotating drum 11. Thus, photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto, or a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of quering rollers 26. At a predetermined time in the course of a copy cycle, the quering rollers 26 are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by belt conveyor 28 to fixing station 29.

Figure 2:
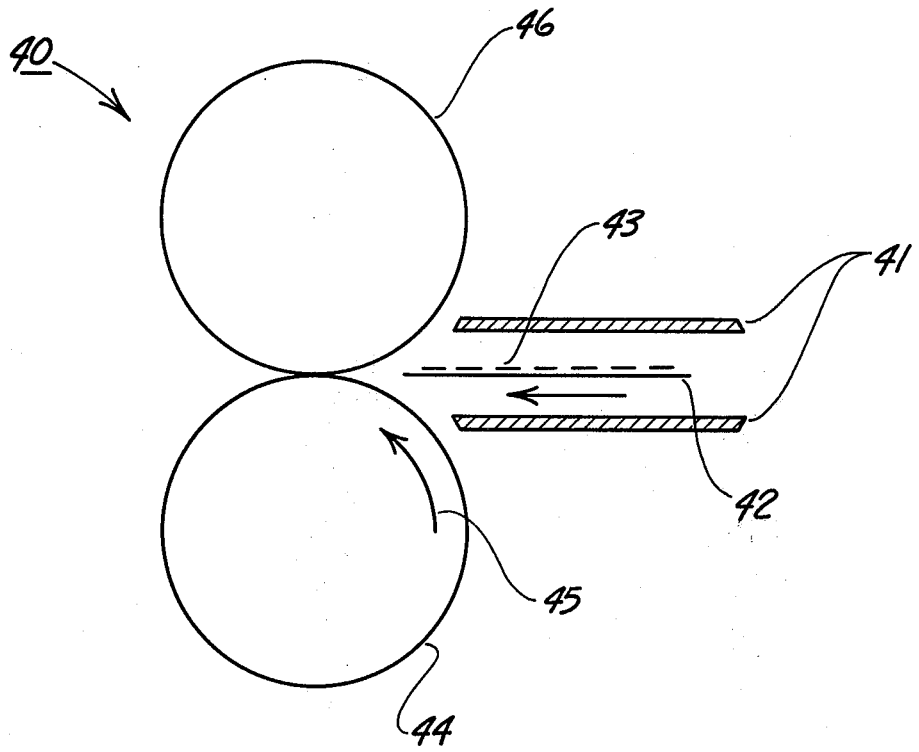
FIG. 2 is a schematic sectional view of an embodiment of a fusing apparatus in accordance with the present invention.

The copy sheet then passes into fixing station 29 which includes a fusing apparatus in which the toner material now residing on the copy paper is fused into the copy paper so as to form a permanent copy of the original document. In accordance with the present invention a fusing apparatus employing the fusing system as shown in FIG. 2, and as more fully described hereinbelow can be used. After the toner image is permanently affixed to the copy sheet, the sheet is advanced to a catch tray 30 for subsequent removal from the copier by an operator.

In order to remove residual toner particles which adhere to photoconductive surface 12 after the transfer of the powder image to the copy sheet, copying machine 10 is provided with a cleaning system generally designated as 31. The cleaning system can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Figure 3:
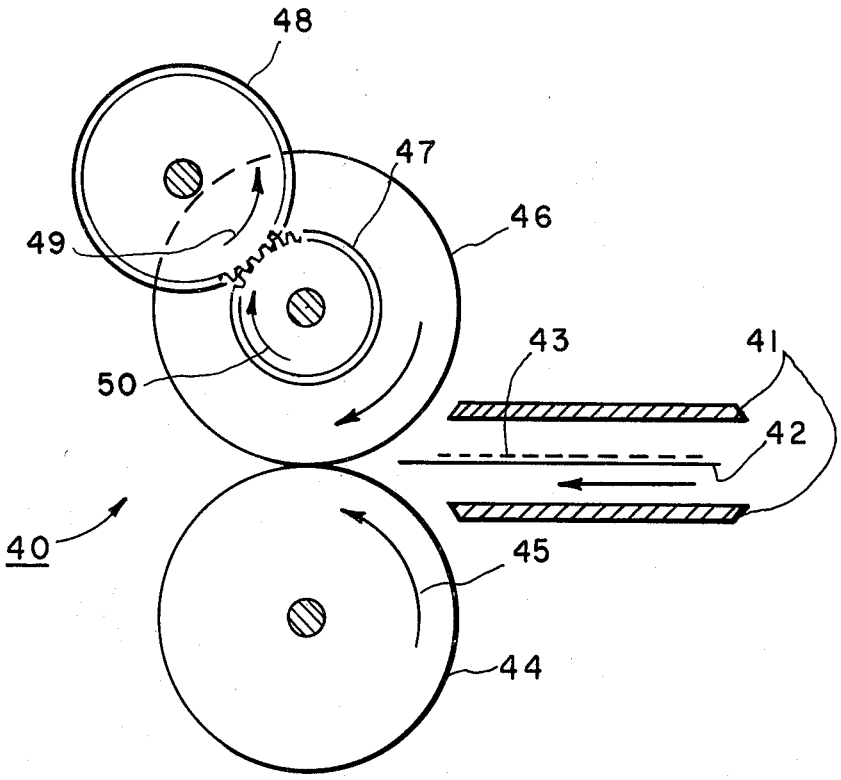
FIG. 3 is a schematic sectional view of a fusing apparatus in accordance with the present invention illustrating an embodiment of the breaking means.

Referring now to the specific subject matter of the present invention, there is illustrated in FIGS. 2 and 3 an embodiment of a pressure roll assembly for use in a cold pressure fusing apparatus in accordance with the features of the present invention. Specifically, there is shown a cold pressure fusing apparatus 40 for use in a xerographic type copying machine for fixing a developed toner image to a copy sheet. Conventional type guide means 41 are adapted to usher a copy sheet 42 having a developed toner image 43 thereon through the fusing apparatus. Fusing apparatus 40 includes a first roller 44 that is rotatably mounted in the copying machine. Driving means (not shown) is operatively connected to roller 44 so as to drive the roller in the direction as shown by arrow 45. A second rotatably mounted roller 46 is positioned in cooperative and pressure contact with roller 44 whereby a nip is formed through which copy sheet 42 can pass under pressure so as to fuse the toner particles to the sheet.

In order to enhance the cold fusing effect of this type of cold pressure fusing system, in accordance with the present invention there is provided a braking means (see FIG. 3) that is operative connected to roller 46. The braking means is capable of applying a controlled torque to roller 46 opposite to the direction that roller 46 is being driven by roller 44. The overall effect that is desired is to apply a light degree of rotatable braking action to roller 46. Specifically the degree of torque should be of a magnitude sufficient to create an effect that facilitates the fusing of the toner particles into copy sheet 42 in addition to the pressure that is normally applied by roller 44 and 46 (without the braking action) without producing substantially any smudging of the toner particles, but of a magnitude insufficient to cause skidding of roller 46 on roller 44. Of course, the specific magnitude of torque that is desired is directly dependent on the type and composition of the toner that is employed. Any suitable means can be used for applying a braking action on roller 46. For example, a suitable arrangement of gears connected to the drive shaft upon which roller 46 rotates can be used for this purpose. As shown in FIG. 3, an example of a suitable arrangement of gears for applying a braking action on roller 46 includes gear 47 (secured to the drive shaft of roller 46) and gear 48 operatively connected to gear 47, the gears traveling in the direction of arrows 49 and 50. When gear 48 is moved at a controlled slower speed then gear 47, a controlled torque is applied to roller 46 opposite to the direction that roller 46 is being driven by roller 44.

When roller 44 is driven and a slight braking effect is applied to roller 46, roller 46 in addition to applying a radial compressive force to the toned image 43 on copy sheet 42, will also apply a slight tangential force thereto. Thus by regulating the degree of braking action in accordance with the type of toner used, the effect will be to apply a very minute spreading or wiping action to toned image 42 that is not great enough to produce smudging, but is of a sufficient magnitude to facilitate the working of the tone particles into the surface fibers of copy sheet 42. By thereby improving the efficiency of getting the toner into the copy sheet, smaller pressure rollers and lower forces may be used, and the appearance of the copy sheets can be improved because of a resultant reduction in the shiny calendered surface finish of the toned surface of the copy sheet.

In accordance with the present invention, the particular sizes that are selected for rollers 44 and 46 can vary, and such selections should be able to be made by one having ordinary skill in the art. Furthermore, the structure for the rolls used in the fusing assembly in accordance with the present invention, and the particular materials used for these rolls can very, and can be selected from any of the well known structures and materials used in cold pressure fusing systems that are known in the art. For example, rollers 44 and 46 can be either of a solid or tubular construction. Since it is possible for toner particles to be offset to the outer fusing surfaces of the fusing rolls, certain coatings can be used to prevent this problem. One possible way to minimize this problem, commonly referred to in the art as "offsetting", would be to provide the outer surfaces of rollers 44 and 46 with an outer surface layer or covering of polytetrafluoroethylene, sold under the trademark "Teflon" by the E. I. DuPont de Nemours & Co., to which a release agent such as, for example, silicone oil is applied. Of course, any of the procedures known in the art for preventing offsetting can be used.

While this invention has been described in conjunction with specific embodiments thereof, it is evident that many alternatives, modifications and variations will be apparent to those skilled in the art. Accordingly, the present invention is intended to embrace all such alternatives, modifications and variations and fall within the spirit of the appended claims.

I claim:

1. In a cold pressure fusing apparatus for use in a xerographic copying machine for fixing a developed toner image to a copy sheet, the combination comprising: a first roller rotatably mounted in said machine; driving means operatively connected to said first roller; a second roller, rotatably mounted in said machine and in pressure contact with said first roller whereby a nip is formed through which copy sheets being fused pass; and braking means operatively connected to said second roller for applying a controlled braking torque to said second roller, said torque being of such magnitude sufficient to facilitate the fusing of toner particles into said copy sheet without producing substantially any smudging of the toner particles, but of a magnitude insufficient to cause skidding of said second roller relative to said first roller.

* * * * *